US006612768B2

(12) United States Patent
Zorzo

(10) Patent No.: US 6,612,768 B2
(45) Date of Patent: Sep. 2, 2003

(54) BROOM PROVIDED WITH A REGULATOR FOR CONTROLLING THE FLOW OF FLOOR CLEANING AND TREATMENT PRODUCTS

(76) Inventor: Bruno Zorzo, Via Ronca 19, 35010 Onara di Tombolo, Padova (IT)

( * ) Notice: Subject to any disclaimer, the term of this patent is extended or adjusted under 35 U.S.C. 154(b) by 0 days.

(21) Appl. No.: 10/247,920

(22) Filed: Sep. 20, 2002

(65) Prior Publication Data

US 2003/0035679 A1 Feb. 20, 2003

Related U.S. Application Data

(62) Division of application No. 09/726,149, filed on Nov. 29, 2000, now abandoned.

(30) Foreign Application Priority Data

Dec. 30, 1999 (LU) ..... 90496

(51) Int. Cl.[7] ..... A47L 1/08; A47L 13/26; A46B 11/04

(52) U.S. Cl. ..... 401/138; 401/139; 401/270; 401/272; 401/273

(58) Field of Search ..... 401/138, 137, 401/139, 140, 268, 270, 272, 273, 278, 279

(56) References Cited

U.S. PATENT DOCUMENTS

| | | | | | |
|---|---|---|---|---|---|
| 2,187,671 | A | * | 1/1940 | Suddarth | 401/138 |
| 2,768,401 | A | * | 10/1956 | Becker et al. | 401/138 |
| 2,990,979 | A | * | 7/1961 | Harrison et al. | 401/140 |
| 4,863,299 | A | * | 9/1989 | Osberghaus et al. | 401/138 |
| 5,213,432 | A | * | 5/1993 | Chappell | 401/273 |
| 6,325,563 | B1 | * | 12/2001 | Matechuk | 401/140 |

FOREIGN PATENT DOCUMENTS

| | | | | |
|---|---|---|---|---|
| DE | 2834-644 | * | 2/1980 | 401/140 |

* cited by examiner

*Primary Examiner*—David J. Walczak
(74) *Attorney, Agent, or Firm*—Thomas S. Baker, Jr.

(57) ABSTRACT

A broom provided with a improved regulator for controlling the flow of floor cleaning and treatment products. This broom has a tubular appendage (29) provided on the bottom of a reservoir (3) for the discharge of liquid and has a removably coupler detachable (31) that is inserted between the tubular appendage (29) and the small flexible tube (5) that transports the liquid to the floor. All these elements are easily cleanable of incrustations and deposits that result from the use of dense or semi-dense fluids, such as floor waxes.

4 Claims, 10 Drawing Sheets

9
22
24
15
23
11
6
22'
15'
21

1
18
13
20
5
51
14
17
12
19
16

12
1
13
60
5
16
6
14
8
11

38
37

37
38

12

37
38
10
36
2
12

38
37
1

10
40
39

42
36

42
36

40
41
39
10

36

10
39
12
40

Fig. 26
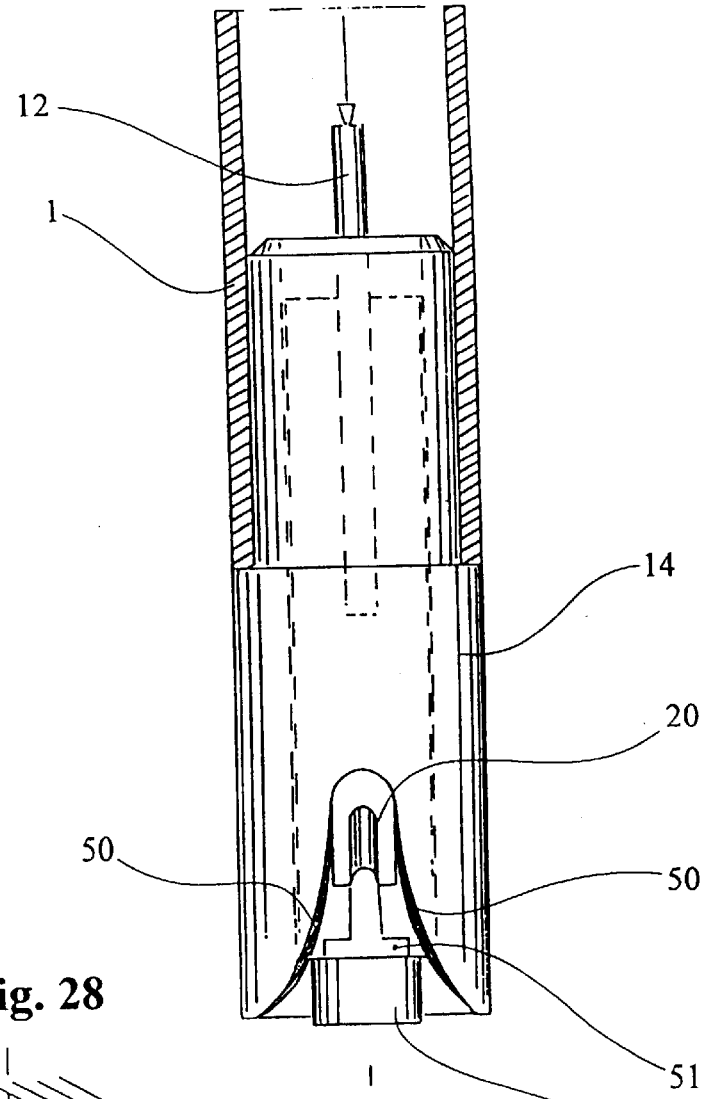
Fig. 28
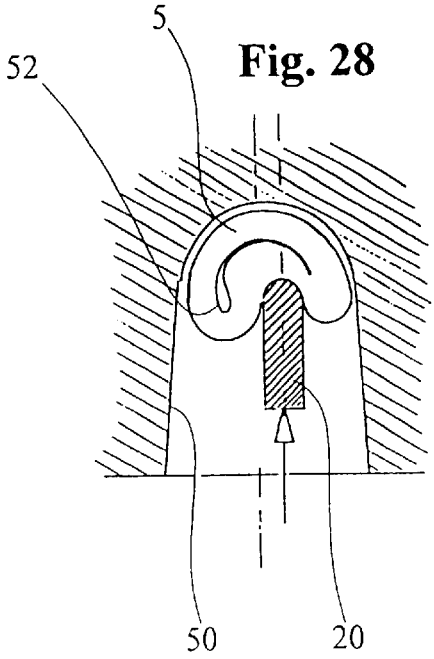
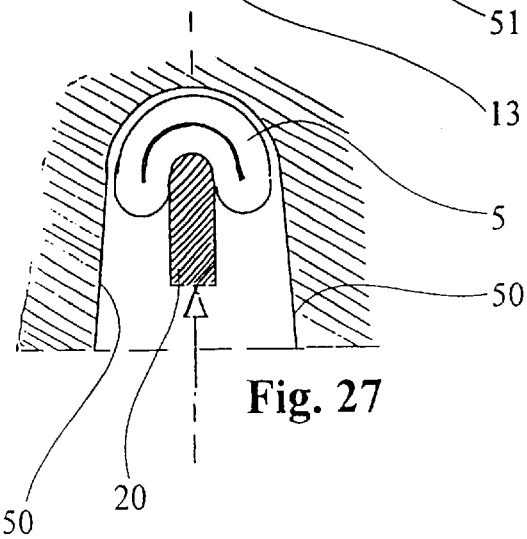
Fig. 27

BROOM PROVIDED WITH A REGULATOR FOR CONTROLLING THE FLOW OF FLOOR CLEANING AND TREATMENT PRODUCTS

This application is a Divisional Application of U.S. Ser. No. 09/726,149, filed on Nov. 29, 2000, now abandon.

FIELD OF THE INVENTION

The present invention relates to the field of cleaning implements, and more particularly to a broom provided of a regulator for the exit of the products for the cleaning and treatment of floors; it is particularly fit to be used with wax, where all the movable elements which can come into contact with wax have been studied to avoid gluing and where the points of possible obstruction of the wax flow, starting from the tank on the handle containing the wax till its exit from the outflow tube, have been studied to be easily cleaned.

BACKGROUND OF THE INVENTION

In the past, floors have generally been cleaned by hand, using mops. The sequence of activities comprised, respectively, washing, drying, and polishing. The materials involved included liquid detergents, pure water without additives, and wax emulsions.

In the case of large floor areas, the mop was used in conjunction with a stiff broom head. The original combination of mop and stiff broom head has been gradually perfected, resulting in true brooms, consisting of a shaft and a support provided with a shaft carrier and equipped, on its lower section, with suitably attached mop heads. The requisite amount of liquid (at the beginning of the process) or wax (at the end) were poured by the operator directly on the floor from various containers. They were then spread across the floor using mops or stiff brooms or a series of brooms equipped with a shaft and a support with an underlying softer element.

Because it was difficult to easily and uniformly spread detergents or polishing products over floors, brooms appeared on the market that were equipped with a bottle holder or their own reservoirs, which were connected either to the bottle holder or to attached reservoirs containing specific devices for regulating the flow of fluids (liquids, waxes, etc.) contained in those reservoirs. In U.S. Pat. No. 3,126,573 from the tank, containing the cleaning products, applied on the handle, a certain quantity of liquid which was controlled and had the desired direction was released by means of a valve on the bottom of the tank itself and by means of the valve's control on the tank's top surface. In U.S. Pat. No. 2,609,557 the tank was put under pressure and the liquid was sprayed on the floor.

Other broom subsequently appeared on the market and these were provided with a reservoir mounted coaxially with respect to the shaft and connected, at the lower part of the reservoir, to a small flexible tube that descended toward the floor after traversing, at a certain distance from the floor, the shaft structure. In U.S. Pat. No. 5,988,920 in order to avoid the restriction of the liquid flow, or its crimping, the transfer of the fluid from the tank to the dispenser is carried out by means of a fluid transfer tube that is positioned within the ball of the universal joint, which connects the tank to the dispenser.

Among brooms now present on the market, stopping and regulating the flow of fluid contained in the reservoir, which passes through the small tube, is based on compression of the small tube, which is effected along a predetermined section of tube using appropriate means. In U.S. Pat. No. 4,863,299 the closure of the flexible small tube is carried out by the bending of the same flexible small tube.

Control of the compression of the small tube is effected by acting on a control knob located on the top of the shaft, which, by means of a wire (using tension) or rod (using pressure), counterbalances the action of a spring, which, during the period the broom is not in use, maintains the small tube in a compressed state.

Brooms sold on the market having a reservoir mounted on the shaft, where regulation of the flow of liquid from the reservoir is realized through compression of a section of small tube made of a flexible material and connected to the lower part of the reservoir, are made as follows.

These brooms consist of:

- a reservoir configured with an opening and mounted coaxially on the shaft, whose outside wall, extending the bottom of the reservoir, rises along the center part, forming a tube that surrounds the shaft
- a small tube made of flexible material connected to a tubular appendage at the bottom of the reservoir and descending toward the floor, traversing the broom shaft
- a shaft that supports a reservoir and is connected, by means of a pivot, to a base plate equipped with a piece of fabric
- a control knob on the top of the shaft grip, which is connected to a device for compressing the small flexible tube where it crosses the shaft (or an extension of the shaft)
- a spring activated device, which, when at rest, maintains the small flexible tube issuing from the reservoir in its fully compressed state at the point where it crosses the shaft (or an extension of the shaft)
- a cover in the shape of an inverted cup, provided with a central tubular cavity running along the shaft.

The interior of the cover is provided with an edge designed to make contact with a corresponding outside edge of the reservoir.

The cover is provided with a skirt along the upper outer part, near the shaft.

The lower outer part of the cover is configured in such a way that, once the cover is lifted upward, it is elastically engaged by the lower part of the shaft grip and retained in place. This enables the operator to use both hands without having to hold the cover open while engaged in activities involving the mouth of the open reservoir.

To initiate the flow of liquid from the reservoir downward, the operator interacts with the control knob located on the top of the shaft grip by moving said control knob downward, whereupon the rod connecting the control knob to the device that compresses the small flexible tube where it crosses the shaft (or an extension of the shaft) is compressed. By varying the extent to which the control knob is depressed, the user can vary the compression of the rod, which acts proportionally against the spring of the device that compresses the small flexible tube.

Liquid spreading brooms available on the market, which have been previously described, present certain drawbacks that become apparent after a short period of use. These drawbacks render the broom itself unusable or result in fairly costly repairs to return the device to its original working condition.

These drawbacks result from the fact that products designed to be spread on a floor are not simple liquids but consist of wax emulsions, which lsoe some oil their own solvent into parts of their containers or along the pathway leading to the floor or, as a result of polymerization problems, become so thick that they form colloid deposits or dense incrustations. This results in the obstruction of small openings and the gumming of joined parts whose function requires that they be separated. In U.S. Pat. No. 2,768,401 it is shown a broom of this type, in which it is not considered the cleaning problem caused by the obstructions of the exit orifice of the conduit from the tank. In addition to this, the closure of the conduit by means of the closure device causes some problems as regards the lasting in time of the conduit, it does not adopt the minimum stress on the conduit's walls, besides, it does not consider the possibility that the tank's plug can easily close and open again even though there are dry or colloidal wax residues caused by the pouring out during the phase of the tank filling up.

Orifices must be cleaned with small rods to clear passages; joined parts that must be separated require the use of the appropriate tools since the force needed to unscrew threaded male and female elements is much greater than the force an operator can exercise manually.

These efforts at cleaning and removal or unlocking not only require more or less lengthy periods of time and related costs, but involve the risk of breaking the coupled parts themselves, which can render the entire broom dysfunctional.

SUMMARY OF THE INVENTION

The present invention improves and overcomes all the problems described till now. The invention consists of a broom provided of a regulator for the exit of the products for the cleaning and treatment of floors; it is particularly fit to be used with wax, where all the movable elements whose wet with the wax should be harmful (the tank's cover and the starting devices of the wax flow tube flattening), have been studied to avoid gluing and to continue their activity without problems; in addition to this, where the points of possible obstructions of the wax flow (in particular at the exit of the tank) can easily and certainly be cleaned; and where the elements occurring for the closure of the outflow small tube by means of its flattening, have been studied to exert the minimum compression by obtaining a perfect closure and determining such a configuration of the aforesaid small tube that it does not cause any outside breaking of the small tube and that it does not favor inside the rise of deposits which could bring to the occlusion of the small tube.

One objective of the present invention is to supply a broom provided with a reservoir having a regulator for controlling the flow of liquid in said reservoir, in particular a fluid wax, which eliminates all the drawbacks found in currently marketed brooms equipped with a reservoir with a liquid flow regulator, by introducing innovative functional and structural concepts and also reducing production and handling costs.

Innovative solutions are introduced by the current patent to eliminate the above drawbacks.

The first innovation involves the discharge orifice provided on the bottom of the reservoir. Here it is realized, in continuity with the reservoir mold, by means of a robust tubular appendage equipped with a sufficiently large opening. Such opening's dimensions are much greater than the inner section of the tube (from 1,5 to 10 times); for this reason it is solved the problem of obstruction of such tubular appendage, since with these dimensions it unlikely obstructs.

In the event of incrustations that are liable to obstruct the opening, this facilitates access to the opening and avoids the risk of breaking the tubular appendage, which would render the reservoir itself unusable. For attaching the small flexible tube that transports the liquid to the floor, a small tubular connector has been provided, which is removably nested on the extremity of the tubular appendage of the reservoir. The dimensions of this removably small tubular connector or removably coupler detachable are such that it inserts on the tubular appendage on the bottom of the tank from one side and on the other side it inserts in the small flexible tube that transports the liquid to the floor. The tubular portion of this removably coupler detachable can be easily cleaned because it is possible introduce a small cleaning rod from either end of the tubular section, or by following the short length of this tubular section. Even if the tubular appendage of the removably coupler detachable should break, this poses no problem with respect to the broom because said removably coupler detachable consists of an inexpensive replaceable part and, as an added precaution, a second removably coupler detachable can be supplied with the original broom.

The second innovation involves the mounting of the reservoir cover.

At present the cover, which is equipped with a central tubular cavity running along the length of the broom shaft, is attached to the reservoir by means of a threaded connection. According to the innovation introduced by the present patent, the cover is no longer screwed in place but pressed on with suitable force using appropriate means. Consequently, whenever the cover must be removed, even if incrustations should occur, causing it to stick to the reservoir, the user only needs to overcome frictional forces and only such force needs to be applied as is accessible to any user.

Appropriate means provided for securing the upper opening of the reservoir, using the non-screw cover, can be snap-on elements consisting of, for example, (elastically) rotatable articulated arms along appendages of the cover, which arms present a hook-shaped extremity for gripping associated appendages present on the outer surface of the reservoir.

Another innovation present in the current patent involves the fabric support, connected in oscillatory manner to an end of the shaft carrier. This support, generally cylindrical in shape, is covered with a wraparound mop on which the edges of the longitudinal opening are proved with snaps. To prevent the mop from slipping or turning around its cylindrical support when it is moved across the surface of the floor, this support is provided with rigid fins radially arranged along its upper surface of revolution, said fins being coplanar with the central stirrup together with the articulated connector joined to the fork-shaped extremity of the shaft carrier.

Another innovation involves the method of attaching the control knob, designed to control compression of the small flexible tube, on the upper extremity of the rod.

Currently, on existing brooms, the control knob and the upper extremity of the rod are attached by means of a screw engaged in the plastic of the control knob, said screw acting superficially on the rod axially threaded into the control knob by pressing it against the wall of the hole. In this way, the rod is secured by taking advantage solely of the mechanical adhesion between the wall of the hole in the control knob and the surface of the rod.

The movement transmitted from control knob to rod over relatively long periods of time compromises their mutual attachment as a result of the fragility of the threads in the plastic material of the control knob accommodating the transverse screw. The impossibility of procuring a secure connection, while eliminating possible sliding of the rod in relation to the screw exercising pressure, compromises efficient flow control through the small flexible tube because compression of the tube depends on perfect positioning of the rod. The solution to this problem was achieved by realizing a transverse cavity in the control knob, said cavity intersecting and terminating at the axial hole present in the control knob into which the rod is inserted. A locking element (preferably having a prisnmatic cross-section) is inserted into this cavity, having a transverse hole corresponding to the transverse cross-section of the rod and a threaded axial hole into which a screw is threaded.

When the rod is inserted into the control knob, it enters and extends beyond the transverse hole housing the locking element. Once the rod is in place in the correct position, the rod is tightened with the axial screw in the locking element so that this element becomes an integral part of the rod.

The coupling thus realized between the control knob and the rod is maintained because, with the locking element mounted on the extremity of the rod, a form of expansion is realized, which distributes the axial forces of the rod along the surface of the seat of the control knob in which the locking element is located.

The innovation facilitates the assembly of the various parts of the broom during construction as well as removal of the rod from the control knob located on the top of the shaft whenever the broom needs to be cleaned or should any maintenance need to be performed on the broom, without compromising the quality of the coupling.

Another innovation concerns the manner in which the small tube is compressed. Whenever compression occurs, complete blockage of the flow of liquid in the reservoir is assured without any possibility of unwanted flow, which could be harmful during use of the broom or could cause the reservoir to drain when the broom is not in use.

To this end the invention proposes a small nose realized with the exact bend radius for the type of flexible tube to be compressed and ensures that the small nose compresses the flexible tube in the middle, without causing any asymmetry. The symmetrical flattening limited to the central area of the diameter of the small tube demands the minimum efforts necessary for the perfect capacity and guarantees the safeguard of the small tube subject to tolerable pressures and it avoids both the gluing between the inner walls and the forming of deposits.

The small nose is centered on the flexible tube by realizing a prismatic coupling between the piston bearing the small nose and the sleeve in which the piston slides, or by enlarging the base of the rib whose summit forms the small nose, in such a way that, when it is near compression position, this base automatically centers the nose by resting on the edges of the opening of the sleeve in which the piston slides.

Various embodiments of the present invention are described below, said non-limiting embodiments being provided for illustrative purpoes only. The following descriptions refer to the attached drawings.

BRIEF DESCRIPTION OF THE DRAWINGS

FIG. 26 is a drawing, seen from the front, of the small nose provided for compressing the small flexible tube (not shown in this drawing, which exits the opening present in the lower extremity of the sleeve connected to the shaft.

FIG. 27 illustrates the manner in which the small flexible tube is compressed by the small nose against the edge found at the top of the opening of the sleeve joined to the shaft whenever the small nose is centered.

FIG. 28 illustrates the manner in which the small flexible tube is compressed by the small nose against the edge on top of the opening of the sleeve connected to the shaft whenever the small nose is not centered.

DETAILED DESCRIPTION

Figure 2:
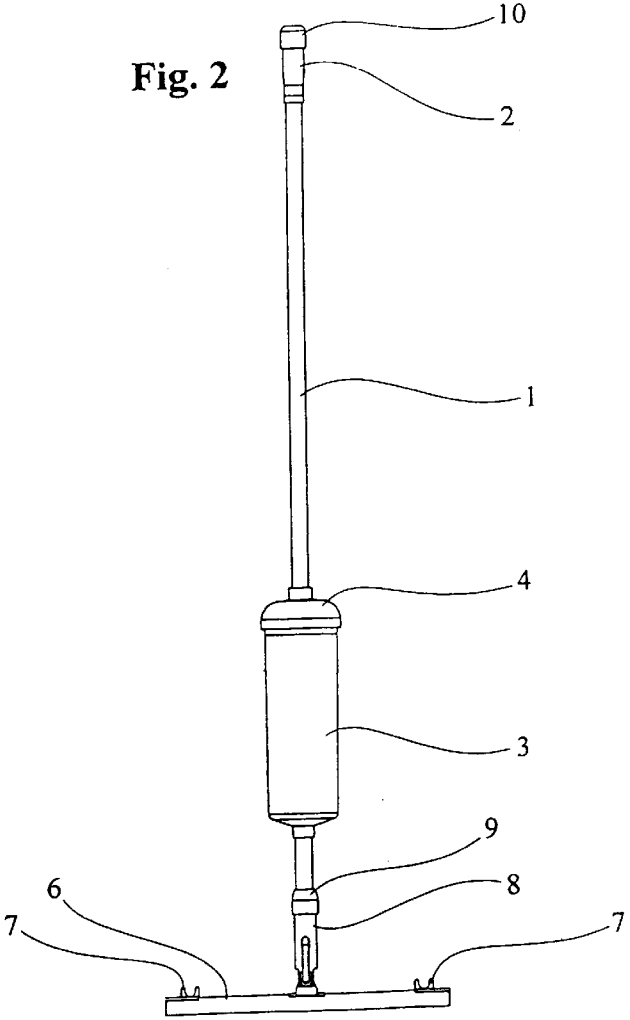
FIG. 2 represents the broom seen from the front.
Figure 1:
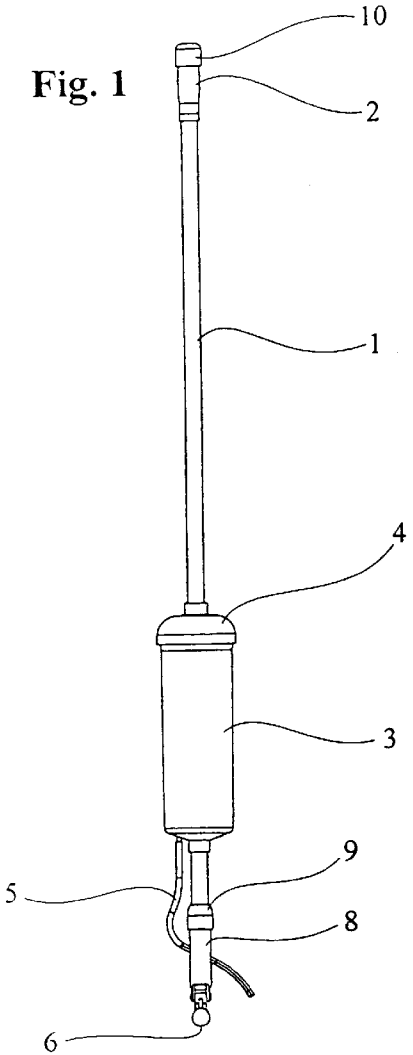
FIG. 1 represents the broom seen from the side.
Figure 4:
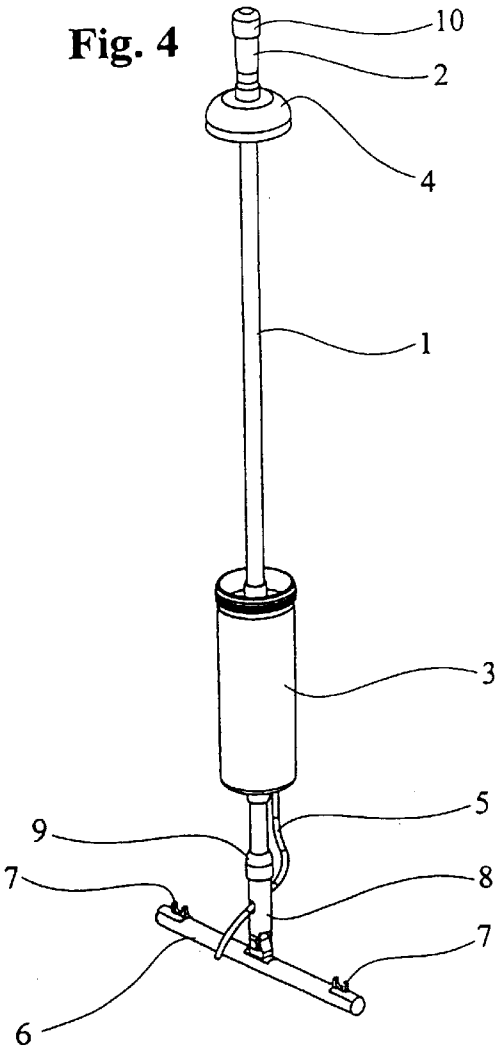
FIG. 4 is the same representation shown in FIG. 3 but with the reservoir mouth open and the cover in the up position, held in place by the lower part of the grip.
Figure 3:
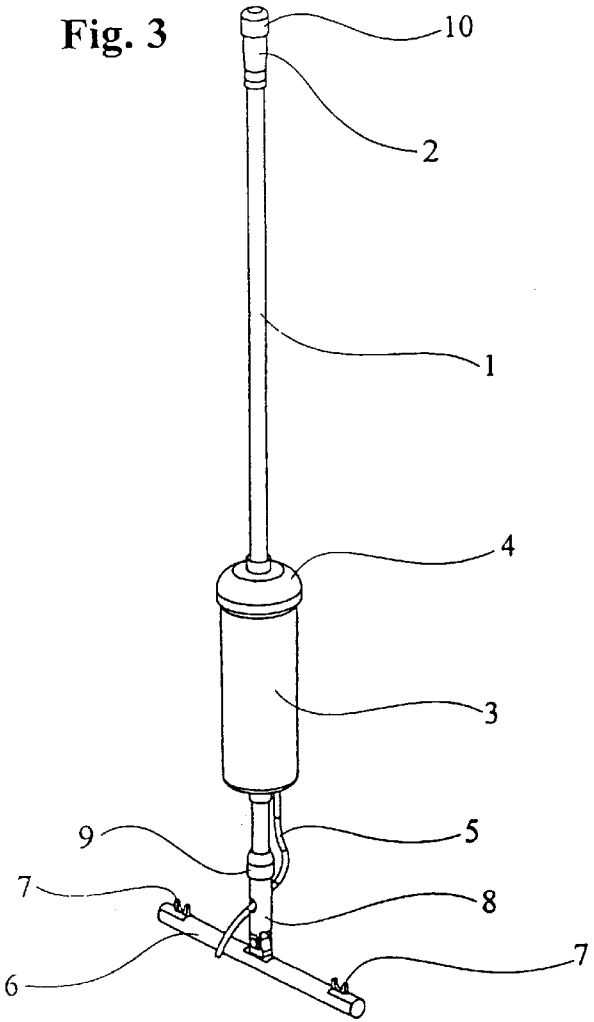
FIG. 3 represents the broom in perspective view.
Figures 5, 6, 7:
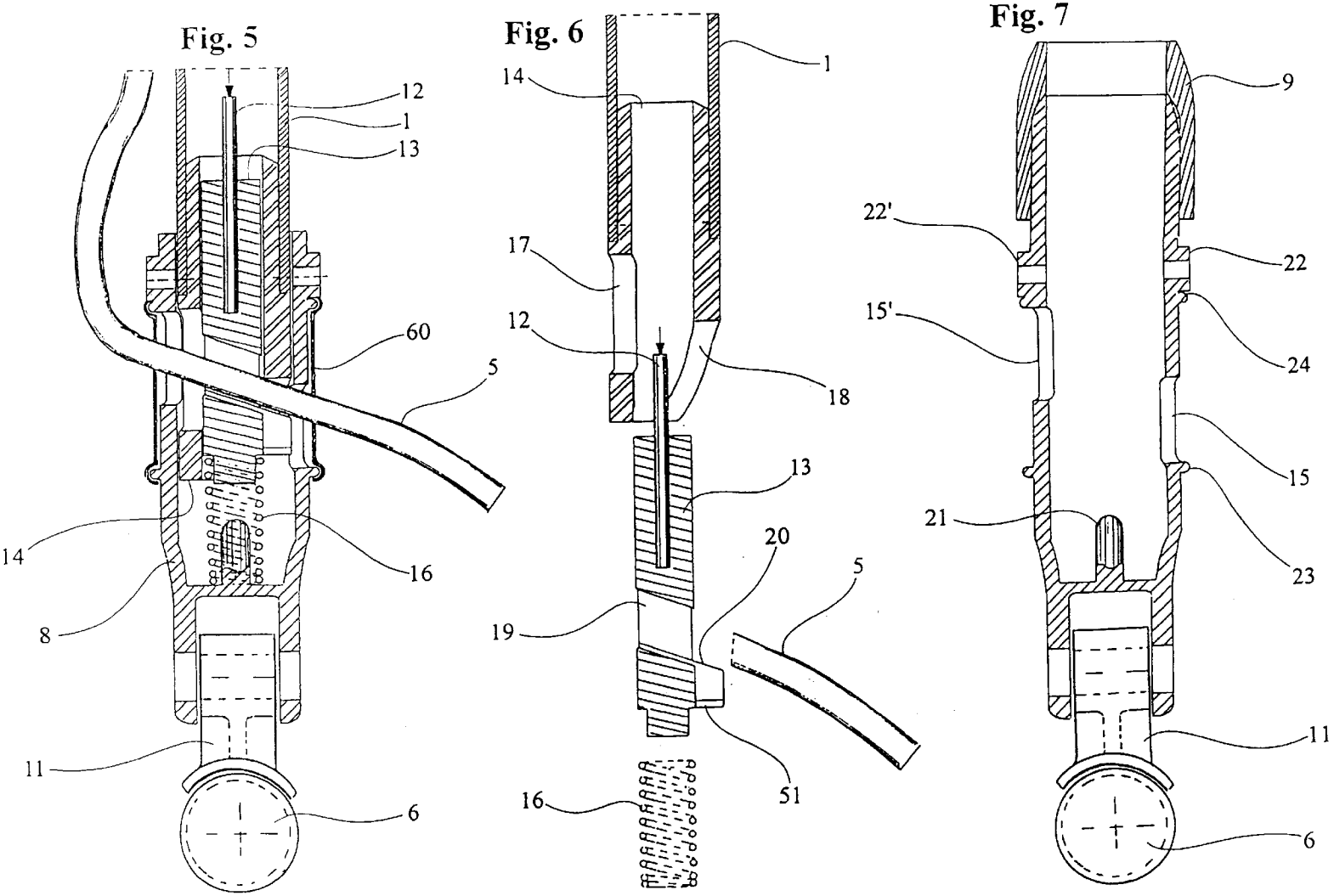
FIG. 5 is a cutaway axial view of the compression assembly for the small flexible tube that drops from the reservoir and extends to the proximity of the floor, in front of the mop support.
FIG. 6 is an exploded cutaway view of the disassembled elements, shown not in use and outside the shaft carrier, said elements constituting the assembly for compressing the small flexible tube.
FIG. 7 is an axial cutaway view of the shaft carrier provided with the pressure fitting and two passages for the transverse screws that ensure attachment of the sleeve to the shaft. The lower portion of the shaft carrier is in the shape of a fork and is connected to the underlying mop support by means of an axis that permits articulation of the support.
Figure 9:
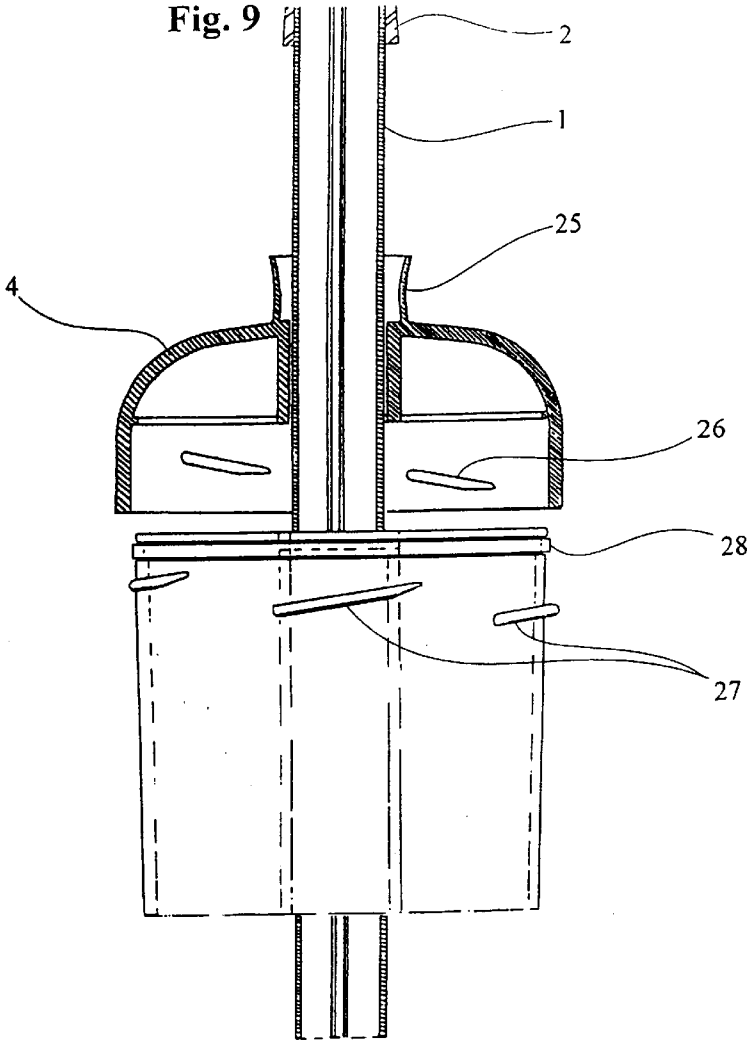
FIG. 9 represents the cover separated from the shaft grip and situated near the mouth of the reservoir. The drawing also illustrates the threads that are provided on the upper outside surface of the reservoir to connect it to the cover.
Figure 8:
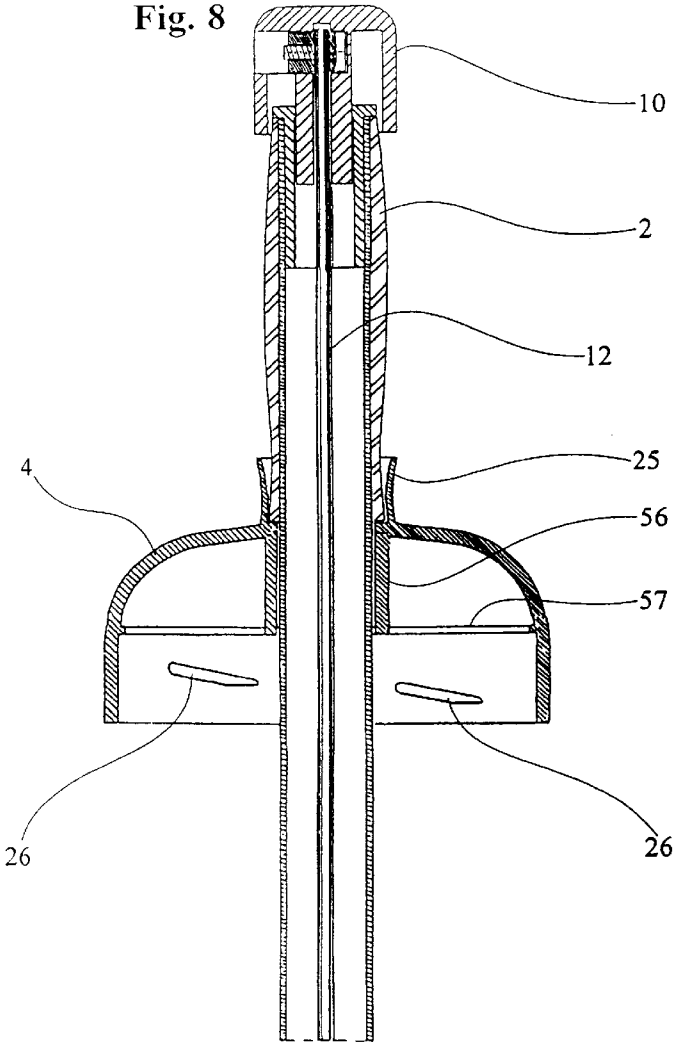
FIG. 8 is a cutaway of the various elements constituting the upper part of the broom and, in particular, the cover of the reservoir retained by the shaft grip.
Figure 10:
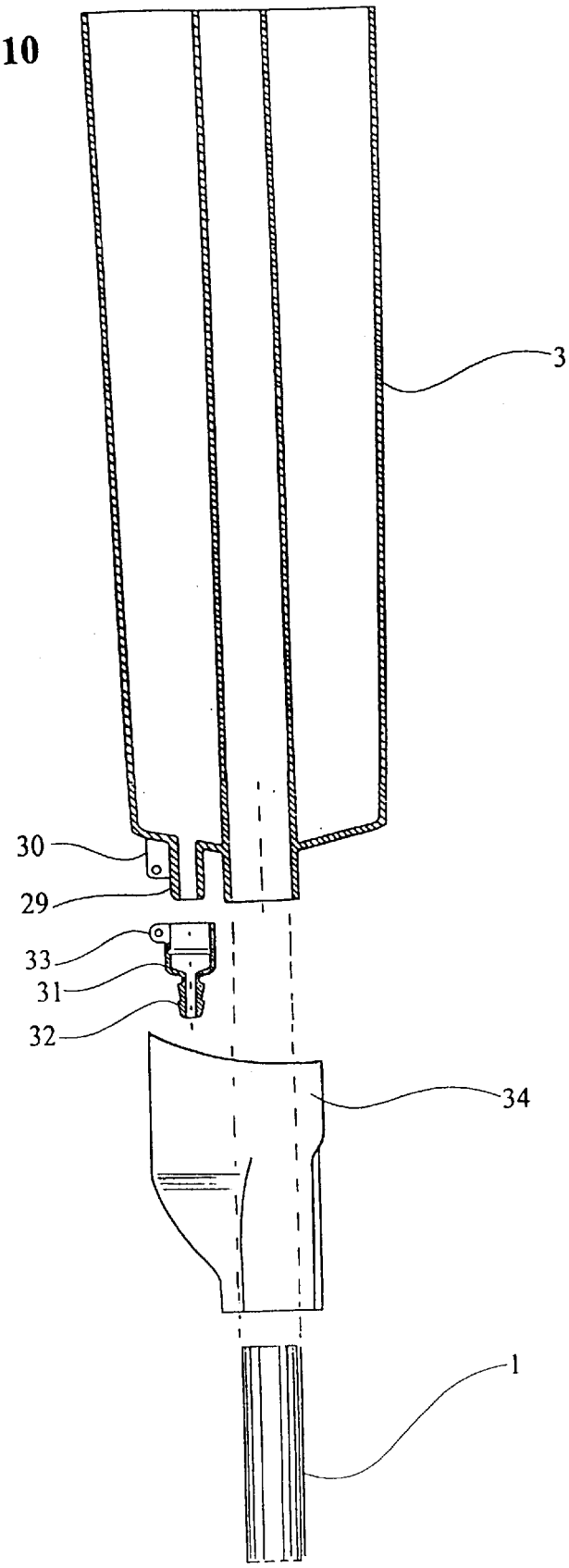
FIG. 10 is a cutaway view of the reservoir, a section of the shaft, a removably coupler detachable that is inserted between the small flexible tube and the tubular appendage that is an integral part of the bottom of the reservoir, and a protective cap for the removably coupler detachable and tubular appendage.
Figures 11, 12, 13, 14:
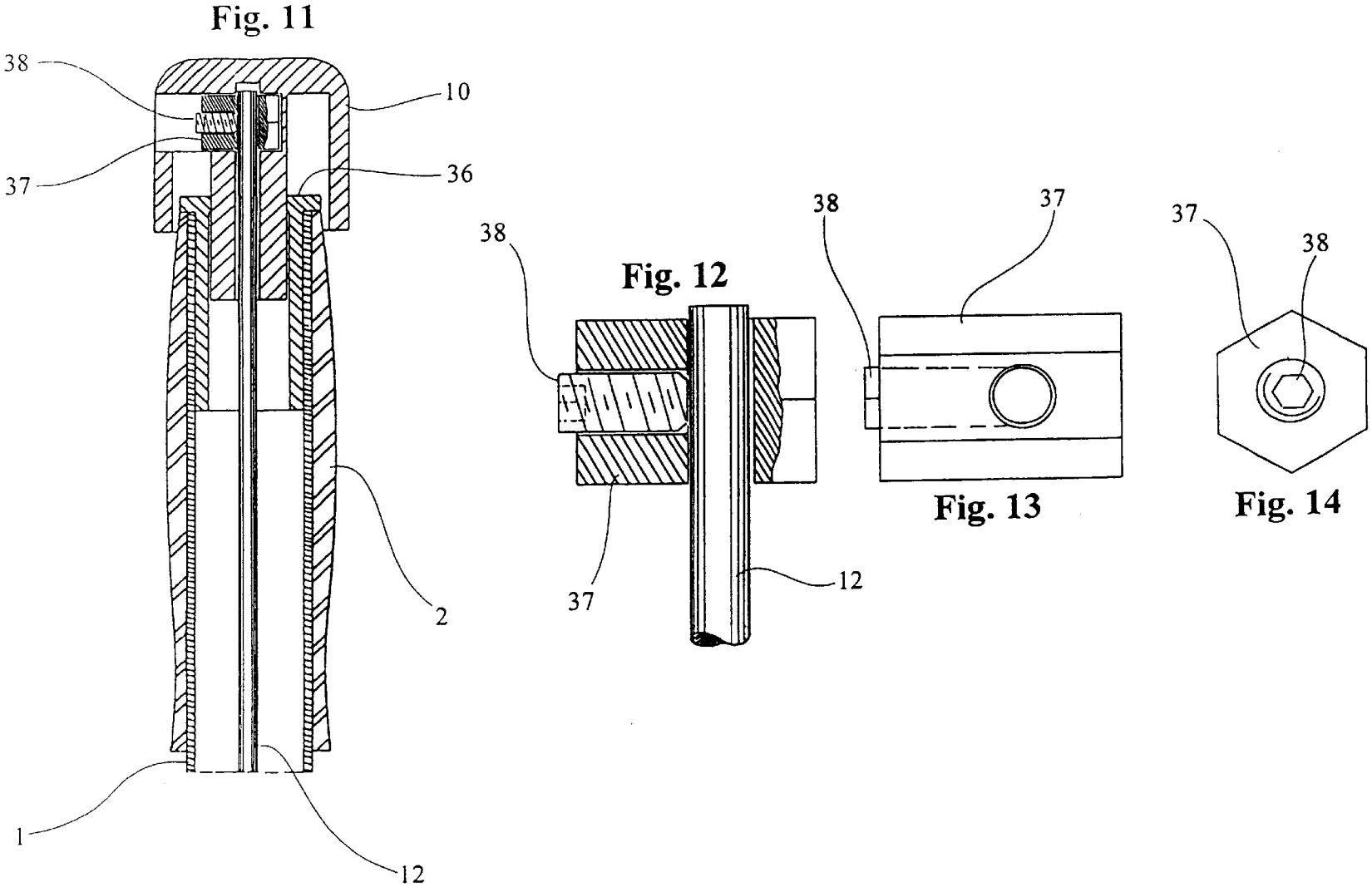
FIG. 11 represents the locking element arranged on the upper extremity of the control rod used to compress the small flexible tube and which is contained inside the control knob that sits on top of the shaft grip.
FIGS. 12, 13, and 14 represent, respectively, a cutaway, side view, and top view of the locking element mounted on the upper extremity of the rod, shown not in operating position, that is, outside the control knob.
Figures 15, 16, 17, 18, 19, 20:
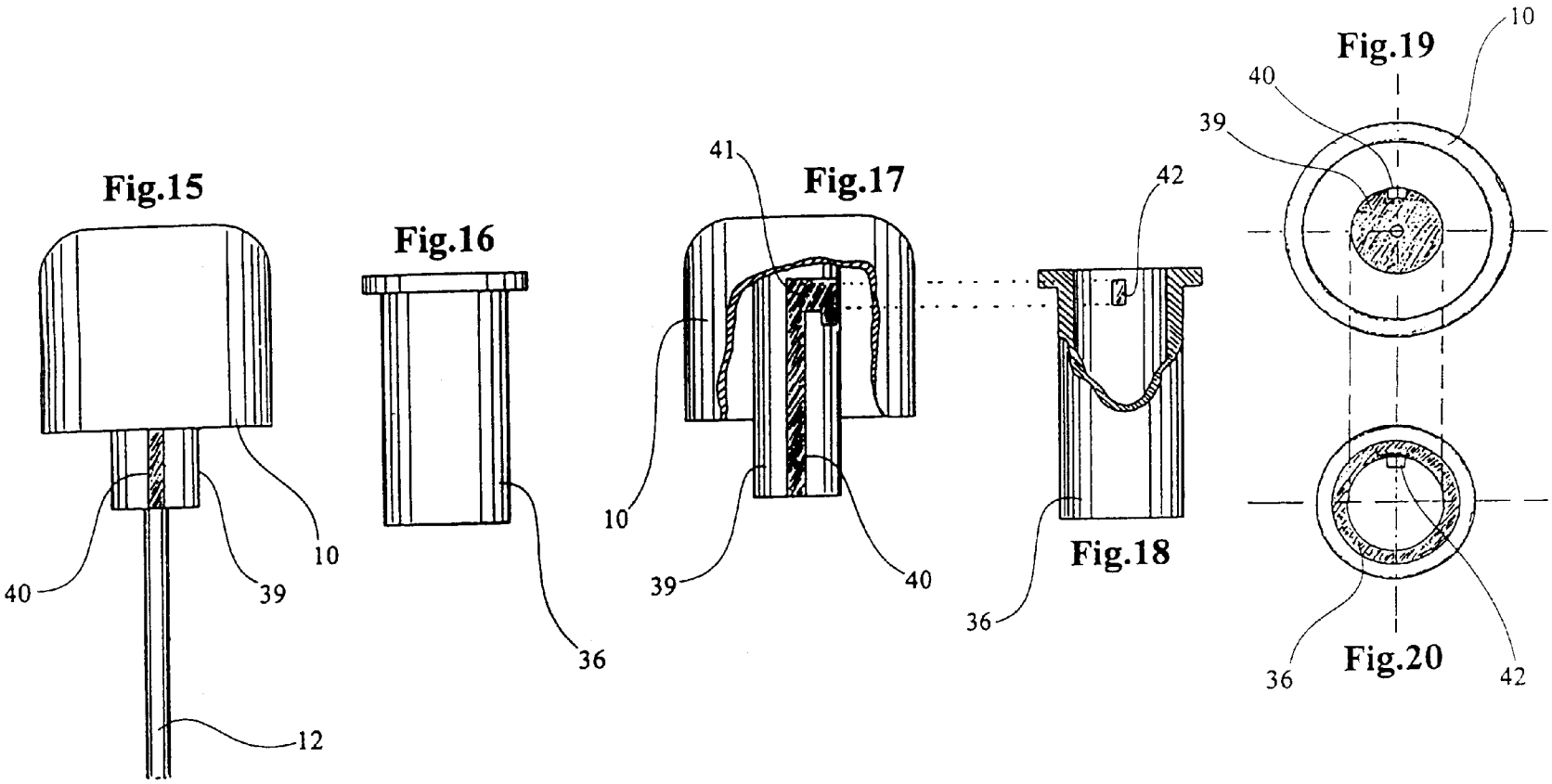
FIG. 15 represents the control knob on the top of the shaft, provided with the manipulating rod to control compression of the small flexible tube controlling the flow of liquid.
FIG. 16 represents the sleeve with external collar that is engaged in the upper end of the shaft and in which slides the hub of the control knob connected to the manipulating rod.
FIG. 17 represents the control knob of FIG. 15 with part of the control knob partially cut away, illustrating the enlarged part realized in the upper part of the hollow present in the hub.
FIG. 18 represents the sleeve of FIG. 16, partially cut away, illustrating the key that is engaged in the hollow of the control knob hub.
FIG. 19 is a bottom view of the control knob shown in FIG. 15, illustrating the hollow that is present in the control knob hub.
FIG. 20 is a bottom view of the sleeve shown in FIG. 16, illustrating the presence of the key.
Figure 21:
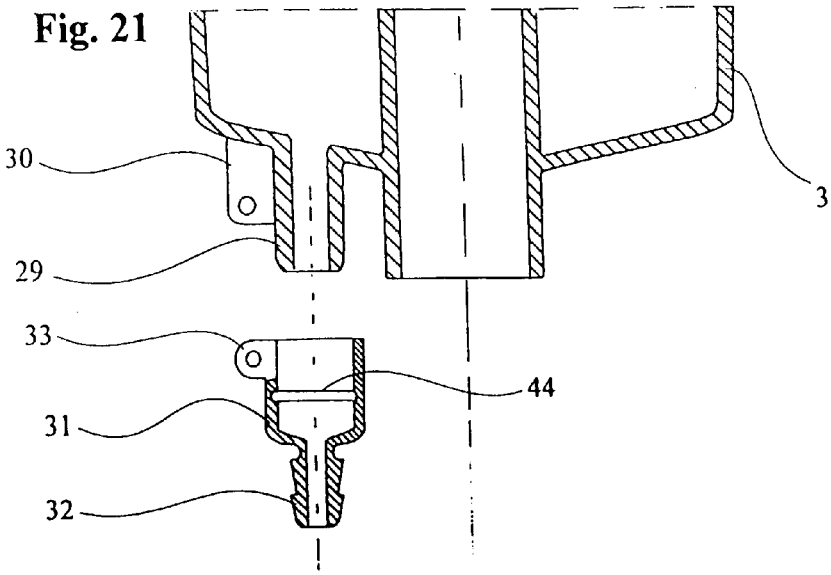
FIG. 21 is a large-scale cutaway of the lower portion of the reservoir, together With its tubular appendage and removably coupler detachable, before it is attached to the appendage, the removably coupler detachable being supplied with a tip for attachment of the small flexible tube.
Figure 22:
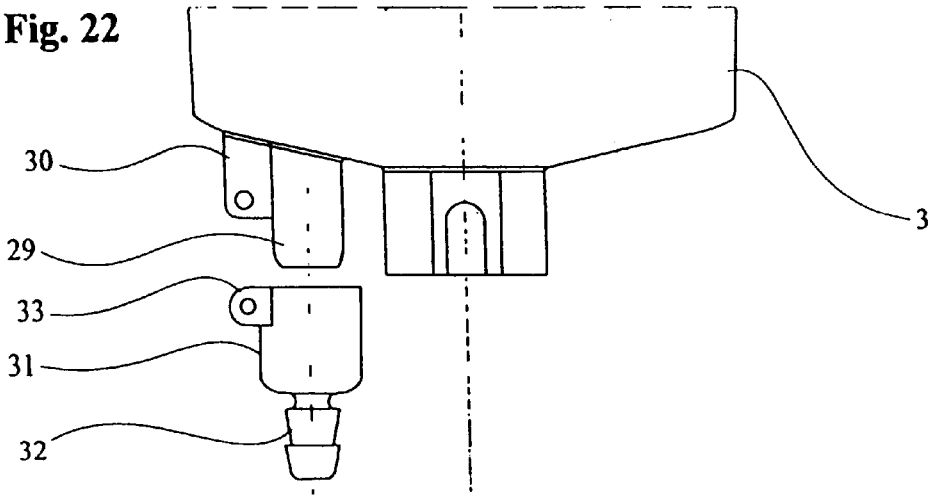
FIG. 22 is the corresponding representation of FIG. 21 seen from the outside.
Figure 23:
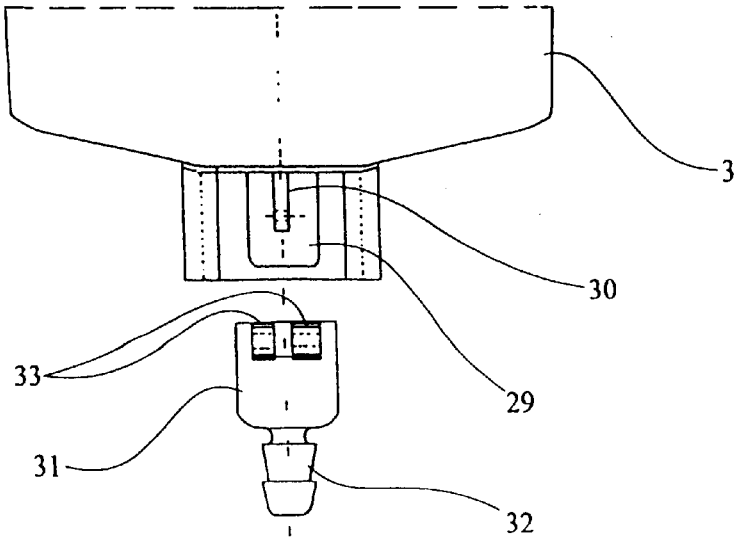
FIG. 23 is the corresponding representation of FIG. 22 after it has been rotated 90 degrees.
Figure 25:
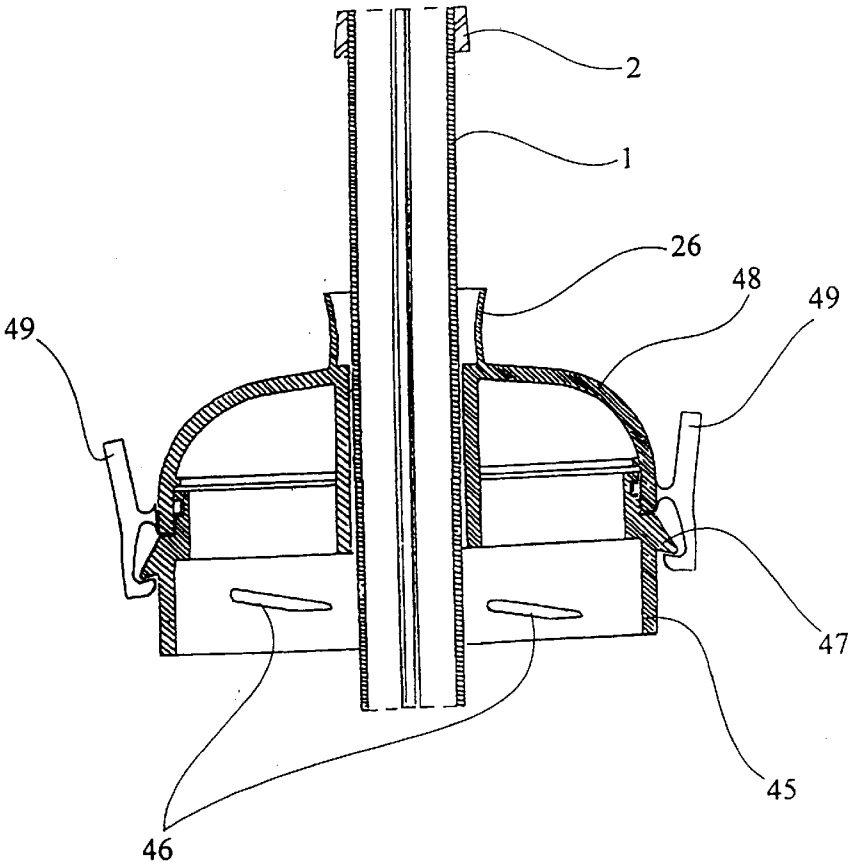
FIG. 25 is a drawing of the cover and the annular element in FIG. 24 in their attached position.
Figure 24:
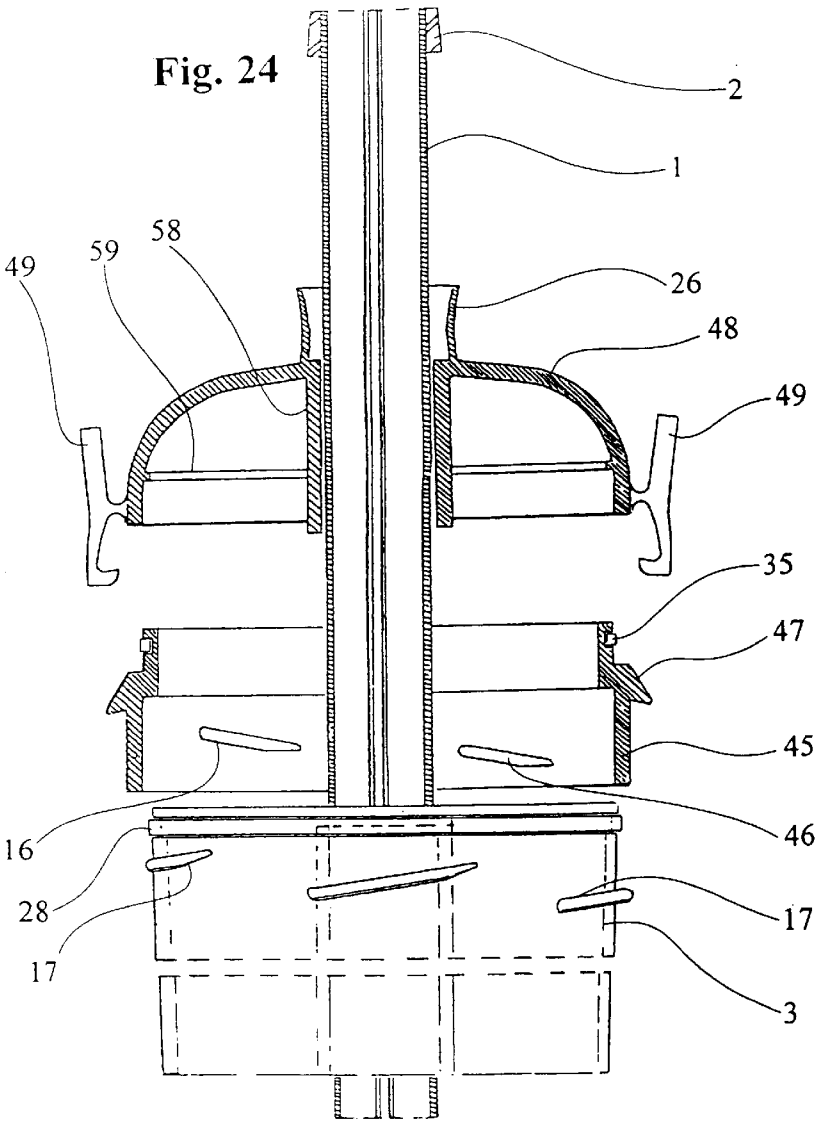
FIG. 24 is a representation of three parts in proximity, specifically, the upper part of a normal reservoir, an annular element, and a type of cover lacking threads.

Referring to FIGS. 1–28, it is shown a preferred execution of the broom provided with a regulator for controlling the flow of floor cleaning and treatment products.

On the handle 1, provided of a handgrip 2, it is applied a tank 3 of the cleaning liquid, provided of a cover 4; on its bottom there is a tubular appendage 29, which, by means of the coupling reducer 32, is connected to the flexible small tube 5 which goes down, after having passed through the handle holder 8, towards the floor.

The handle holder 8, is fixed towards the handle 1 by means of a lock ring 9 and on the opposite side the handle holder hinges by means of a bracket 11 the small board holding the cloth 6 provided of flaps 7 having the function to avoid cloth traverses and rotations towards the small board.

Up the handgrip 2 it is coaxially positioned a knob 10 which is connected to the maneuvering rod 12; at its opposite end, the same rod is connected to the small piston 13 whose lowering reduces or eliminates the flattening of the flexible tube 5 contrasting the push upwards of the spring 16 within the handle holder below the small piston 13.

The connection of the rod 12 to the knob 10 is carried out by means of a clamp which is integral with a knob 10, in prismatic section 37; the clamp is provided of a traversal hole for the passage of the rod 12 and supplied of an axially threaded hole for the insertion of the screw 38 which determines the clamping in a vice of the rod 12 to the knob 10.

Concentrically inside and integral with the knob 10 there is a tap 39 centrally perforated for the passage of the rod 12, its diameter is lower than the bush 36, this last one is provided of a head and it is inserted inside at the top of the handle 1.

In order to guarantee the axial movement of the knob 10, it has been foreseen that the tap 39 which is integral with the knob 10 is provided of a slot 40 inside which the small key 42 within the bush 36 can run.

An extension 41 of the slot 40, enables, upon the rotation of the knob 10, and then of the rod 12 and of the small piston 13 connected to the knob, the small key 42 to enter the extension 41 so as to keep the lowered position reached by the knob 10 in comparison to the handle 1. The rod 12 is integrally connected, at the opposite end to the fixing knob 10, with a small piston 13, which runs inside a bush 14 fixed at the lower end of the handle 1. The small piston 13 has a nib 20 which, when the knob 10 is released, flattens only at the center the small tubes 5 against the top of the border 18 of the bush 14, this last one is coaxial with the small piston 13.

The correct flattening of the small flexible tube 5, by means of the nib 20, without leaving a residual opening 52 of the inner hole of the small flexible tube 5 (on the contrary when it is dissymmetrical flattened), is guaranteed by the lower extension (extended light shoe) 51 which centers itself against the borders 50 of the opening 18 in the lower area of the bush 14 and it is guaranteed by the fact that the small tube is centered within the borders 50 of the opening 18.

It has to be noted that the flexible small tube 5 passes through the small piston 13 throughout the hole 19, it passes through the bush 14 throughout the slit 17 and the opening 18 and it passes through the slits 15 and 15' on the handle holder 8.

In order to guard the moving elements it is foreseen an elastic bush 60 near the crossing area; this bush prevents the waste things from getting in throughout the slits and 15' of the handle holder. The foresaid elastic, bush 60 is kept in position by means of two circumferential external rises 23 and 24 of the handle holder 8.

The attachment to the handle holder 8 of the bush 14 is carried out by means of some screws passing through the two diametrically opposed seats 22 and 22' foreseen on the handle holder's 8 body. The spring 16 which exerts its activity between handle holder 8 and the small piston 13 is kept in guide by a protuberance 21 which sticks out on the bottom inside the handle holder.

The tank 3 is provided of a cover 4 in the upper part; the cover has an inner tubular part 56 which is coaxial to the handle 1 and in the upper part, always coaxially, it has a finned appendage 25 which enables itself to engage temporarily with the handle 2, when it must be raised up as regard the top of the tank 3 to arrange the tank 3 for its filling up throughout its upper opening with the cleaning liquids. The cover 4 presents a lower inner band of the thread parts 26 to couple with the thread parts 27 in the upper outside band of the tank 3. The stop of the screwing is caused by the encounter of the upper border of the tank 3 with a circumferential rise 57 on the inner surface of the cover 4. For a greater capacity between the cover 4 and the tank 3 it has been arranged for the insertion of a gasket 28 applied outside close to the upper border of the tank 3.

A different execution of the closure of the tank 3 provides for the attachment of the annular element 45 supplied in its inner band of threaded parts 46, which engage themselves with the corresponding threaded parts 17 on the tank's outside upper band. This annular element 45 presents, on its circumferential outside surface, a circular appendage which is chamfered at the top and at the lower part it is undercutted where some levers 49 hook themselves; these levers are elastically hinged on the external band of the cover 48, where the aforesaid levers have a lower little arms ending like a hook to engage itself in the undercutted flanging of the annular element 45 and an upper little arm to take the hooking of the lower little arm off. For a better capacity on the upper external side of the element 45 a gasket 35 has been provided for.

The tank 3 has a tubular appendage 29 on the external part of the bottom, for the outflow of the cleaning fluid; this appendage is properly ribbed with the flap 30. The aforesaid flap 30, provided with a hole, more than stiffening the tubular appendage 29 it enables the reducing coupler detachable element 31 to be fixed, once it has been coupled by means of a screw clasping against the aforesaid flap 30 the two elastic flaps 33, they are perforated them too, they detach from the aforesaid reducing coupler detachable element 31.

This reducing coupler detachable element 31 has a gasket 44 (or) inside which is inserted in the proper seat and it guarantees the perfect capacity, once the coupling with the tubular appendage 29 has been carried out.

This reducing coupler detachable element 31 is provided on its opposite side of an appendage 32 which can be coupled with the tubular appendage 29 for the attachment of the small flexible tube 5. One has provided for a guarding shroud 34, under the tank 3 and, which, from the handle 1, encloses both the tubular appendage 29 and the reducing coupler detachable element 31 to safeguard both of them from possible impacts during the use of the broom, since they could cause its breaking.

The cleaning of possible deposits and/or obstructions and/or gluings of the cleaning liquid between the tubular appendage 29 and the small flexible tube is possible and of easy execution since when it is necessary the removably detachable coupler 31 is easily decoupled from the tubular appendage 29 on the bottom of the iank 3 for the outflow of the cleaning liquids.

The relatively large hole (from 1,5 to 10 times the dimensions of the inner section of the small tube) of the tubular appendage 29, which can be reached from the external side of the tank, can easily be removed from the possible deposits and/or obstructions and/or gluings of the cleaning fluid without being afraid to damage the tubular appendage 29 putting the tank out of order.

Also the cleaning of the through hole of the removably detachable coupler 31, once this has been detached from the tubular appendage 29 and from the flexible small tube 5, it is extremely easy to use since that the aforesaid hole can be reached from both ends and since that the aforesaid removably detachable coupler 31, free from any couplings, can be oriented all the same.

The improve of the closure of the outflow of the liquid through the flexible small tube 5 by means of the nib 20 supported by the element 13, one has obtained the centring of the same nib 20 as regards the flexible small tube 5, which limits the flattening of the small tube 5 only to the central part, leaving out the side parts.

As a matter of fact when one releases the upper knob where it is linked the rod 12 connected with the pallet 13, letting the contrast spring 16 act upwards between the element 8 and the pallet 13, the pallet 13 goes upwards obliging the flexible small tube to center itself within the opening 18 in the lower area of the bush 14; in addition to this, the nib 20, kept in guide by the small light shoe 51 which centers itself as regards the borders 50 of the walls 18 of the element 14, provides for flattening it centrally and symmetrically with the minimum stress to obtain the perfect closure and not stressing the outside borders of the flexible small tube 5 and to avoid their deterioration because of an excessive pressure since they might bring the same small tube to the breaking.

The improve of the opening of the flexible small tube consists in that whenever the small nose 20 is not compressing the small flexible tube 5 that serves to discharge liquid from the reservoir 3, it can be displaced transversally with respect to the edges 50 of the opening 18 of the sleeve 14, by allowing small torsion-free rotational movements of the rod 12 connected to the control knob 10 whenever said control knob 10 is placed in a position such that the enlargement 41 of the hollow 40 in its hub 39 falls opposite the key 42 present in the sleeve 36 into which the hub 39 is inserted.

The improve of the closure of the tank's opening is realized by means of a cover that is pressed against the mouth, said cover 48 (or the upper outside surface of the reservoir 3) being provided with respective locking elements 49 and the upper outside surface of the reservoir 3 (or the outside surface of the cover 48), with respective appendages 47 that facilitate the closure of locking elements 49.

A further improving execution of the closure of the opening of the standard tanks, provided with threads, is obtained by equipping them with associated annular elements 45 that are internally provided with threads for screwing and externally, with appendages 47 for locking, whereby a mouth can have an opening capable of being closed by means of a cover 48 that is applied under pressure and provided with locking elements 49.

A further improve of the functioning of the broom is obtained by foreseeing the presence of an elastic sleeve applied to the shaft carrier 8 opposite the region crossed by the small flexible tube 5 and which prevents debris from entering the openings in the shaft carrier.

Another improve for the easiness and safety during the assemblage and in the safety of the functioning is obtained in the ways of the attachment of the upper extremity of the rod 12 to the control knob 10 which is realized by means of a locking element with a prismatic cross-section 37, which is tightened by a screw 38 inserted in a hollow associated with the control knob.

The above description reveals the innovativeness that characterizes the present invention, which should be understood as describing and representing only one example of a preferred embodiment of the invention. The present patent does not exclude any variants or improvements those skilled in the art might realize by means of the teachings based on the inventive concept embodied in this patent.

What is claimed is:

1. Broom with a regulator for controlling the flow of floor cleaning and treatment products, characterized by a handle (1), a tank (3) affixed to the handle (1) having a small flexible outlet tube (5) which passes through openings (17) and (18) formed in a sleeve (14) attached to the handle (1), a movable pinch nose (20) actuated by a control rod (12) mounted within sleeve (14) which compresses the small flexible tube (5) against an edge (50) of a rounded opening (18) formed in sleeve (14) for regulating and preventing the flow of liquid, said nose (20) being rounded such that, when it compresses the tube (5), the tube (5) is automatically centered on the edge (50) of the opening (18) of the sleeve (14) so as to symmetrically compress the small flexible tube (5) against the edge (50) and prevent possible leakage of fluid through the small tube (5) when it is fully compressed.

2. Broom with a regulator for controlling the flow of floor cleaning and treatment products according to claim 1, characterized in that movable pinch nose (20) is mounted on a movable piston (13) connected to the control rod (12) having a control knob (10) movable in said handle (1), said control knob (10) having a hub (39) with a hollow (40) and a slot (41) formed in said hollow (40), a sleeve (36) having a key (42) mounted in handle (1), and wherein said hub (39) moves axially within said sleeve (36), said control knob (10) and said piston (13) movable axially between a first position in which nose (20) compresses tube (5) against edge (50) of opening (18) to prevent fluid flow therethrough and a second position wherein nose (20) is not compressing tube (5) and tube (5) is spaced from edge (50) to allow the passage of fluid therethrough and wherein when said control knob (10) and piston (13) are maintained in said second position by rotational movement of control knob (10) wherein said control knob (10) is placed in a position such that said slot (41) of hollow (40) in hub (39) falls opposite said key (42) in sleeve (36) and said key (42) is received in slot (41).

3. Broom provided with a regulator for controlling the flow of floor cleaning and treatment products according to claim 2, characterized in that the attachment of the upper extremity of rod (12) to control knob (10) is realized by means of a locking element with a prismatic cross-section (37), which is tightened by a screw (38) inserted in a hollow associated with the control knob (10).

4. Broom provided with a regulator for controlling the flow of floor cleaning and treatment products according to claim 1 characterized in that it comprises an elastic sleeve applied to a shaft carrier (8) adjacent openings (17) and (18) of sleeve (14) which prevent debris from entering said openings.

* * * * *